United States Patent [19]

Wagar

[11] 4,433,226

[45] Feb. 21, 1984

[54] METHOD AND APPARATUS FOR INDUCTION HEATING OF AN ELONGATED WORKPIECE

[75] Inventor: Richard L. Wagar, Wadsworth, Ohio

[73] Assignee: Park-Ohio Industries, Inc., Shaker Heights, Ohio

[21] Appl. No.: 320,550

[22] Filed: Nov. 12, 1981

[51] Int. Cl.[3] ..... H05B 6/06

[52] U.S. Cl. ..... 219/10.41; 219/10.71; 219/10.77; 219/10.79; 219/10.57

[58] Field of Search ..... 219/10.41, 10.43, 10.57, 219/10.49, 10.69, 10.71, 10.75, 10.67, 10.79; 266/129, 124; 188/146, 150, 154

[56] References Cited

U.S. PATENT DOCUMENTS

| | | | |
|---|---|---|---|
| 294,932 | 8/1882 | Lewis . | |
| 358,446 | 3/1882 | Lewis . | |
| 390,409 | 6/1882 | Lewis . | |
| 1,690,612 | 11/1928 | Anderson et al. . | |
| 1,764,068 | 6/1930 | Crook . | |
| 2,281,850 | 5/1942 | McKinney | 255/28 |
| 2,490,104 | 12/1949 | Strickland | 219/13 |
| 2,811,623 | 10/1957 | Guthrie | 219/10.41 |
| 3,057,985 | 10/1962 | Biringer | 219/10.41 |
| 3,489,620 | 1/1970 | Current | 148/146 |
| 3,596,037 | 7/1971 | Seulin et al. | 219/10.43 |
| 3,604,882 | 9/1971 | Seyfried | 219/10.69 |
| 3,610,861 | 10/1971 | Storey | 219/10.77 |
| 3,743,808 | 7/1973 | Kasper | 219/10.77 |
| 3,784,780 | 1/1974 | Laughlin et al. | 219/10.43 |
| 4,075,450 | 2/1978 | Lavins, Jr. | 219/10.71 |
| 4,093,839 | 6/1978 | Moliterno et al. | 219/10.41 |
| 4,117,293 | 9/1978 | Wicker et al. | 219/10.41 |
| 4,158,758 | 6/1979 | Kunioka et al. | 219/10.71 |
| 4,289,944 | 9/1981 | Reese | 219/10.41 |
| 4,307,276 | 12/1981 | Kurata et al. | 219/10.41 |

FOREIGN PATENT DOCUMENTS

| | | |
|---|---|---|
| 2801661 | of 0000 | Fed. Rep. of Germany . |
| 1533955 | of 0000 | Fed. Rep. of Germany . |
| 1508430 | 10/1969 | Fed. Rep. of Germany . |
| 815003 | of 0000 | France . |
| 1557249 | of 0000 | France . |
| 2360674 | of 0000 | France . |

*Primary Examiner*—B. A. Reynolds
*Assistant Examiner*—M. M. Lateef
*Attorney, Agent, or Firm*—Body, Vickers & Daniels

[57] ABSTRACT

A method for uniformly heating a workpiece such as a sucker rod or the like having a uniform cross-section over a major portion of its length and an enlargement adjacent each end thereof. A multi-turn inductor is coaxially disposed around an elongated workpath with the rod being longitudinally moved along the workpath at some preselected rate of travel toward the inductor entrance end. The inductor is normally at one level of energization adapted to inductively heat the enlargement adjacent the rod leading end to some predetermined temperature as it passes through the inductor. After a first predetermined time interval triggered by the rod as it travels along the workpath, the inductor is automatically placed at another, lower level of energization for inductively heating the elongated major portion to the same predetermined temperature. The inductor then automatically returns to the normal level of energization for inductively heating the enlargement adjacent the rod trailing end to the predetermined temperature. The inductor energization levels are adjustable to accommodate different rod and feed characteristics. Also, a plurality of like inductors may be electrically interconnected to facilitate the simultaneous heating of a plurality of the rods.

2 Claims, 8 Drawing Figures

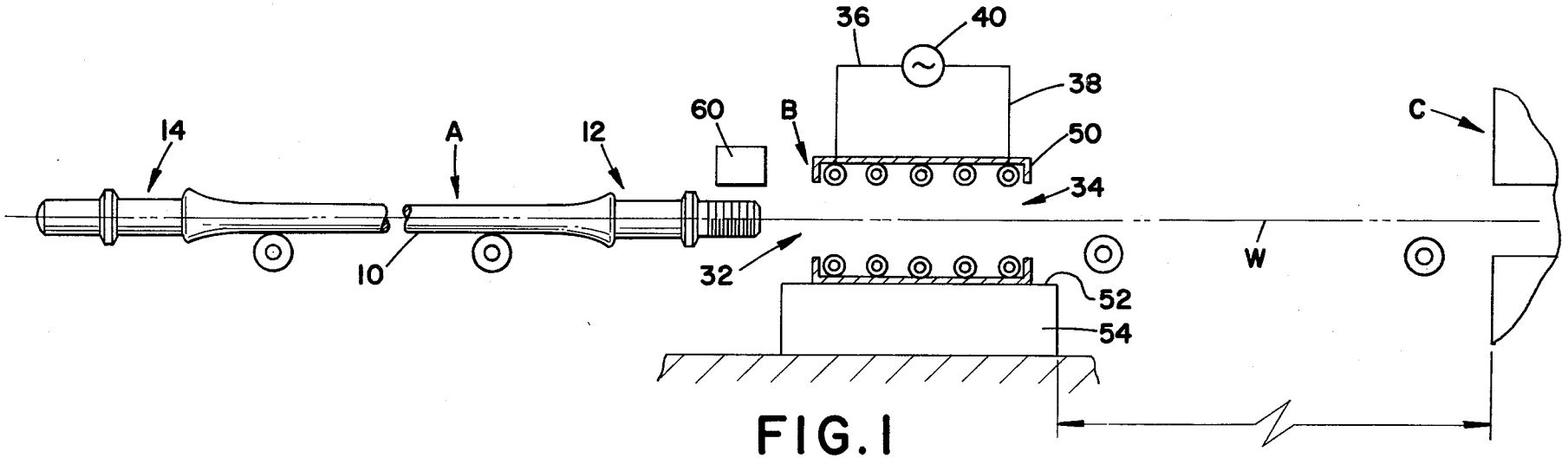
FIG. 1
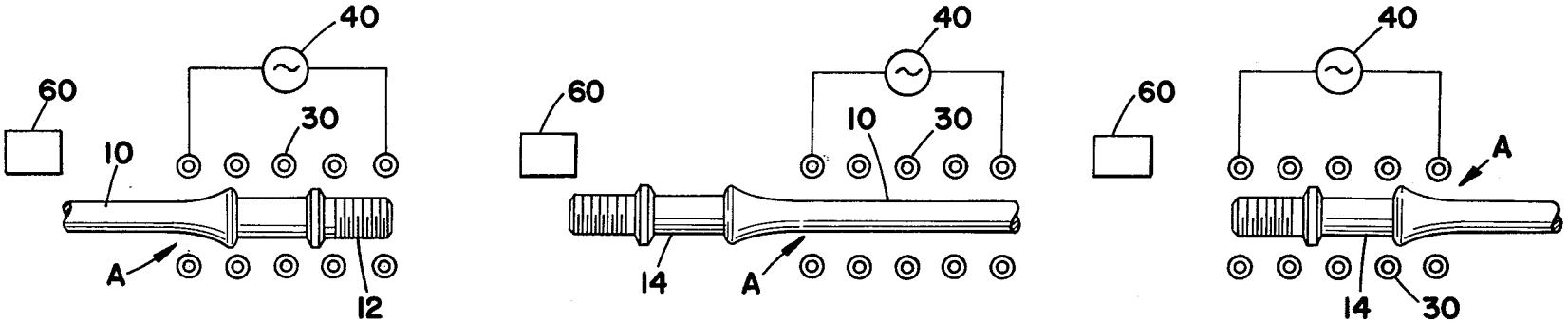
FIG. 2
FIG. 3
FIG. 4

METHOD AND APPARATUS FOR INDUCTION HEATING OF AN ELONGATED WORKPIECE

BACKGROUND OF THE INVENTION

This invention relates to the art of induction heating and, more particularly, to method and apparatus for uniformly heating an elongated workpiece having a uniform cross-section over the major portion of its length with at least one enlargement disposed therealong.

The invention is particularly applicable to heating sucker rods which are employed in oil wells and the like and will be described with particular reference thereto. However, it will be appreciated that the invention has broader applications and may be used for inductively heating a variety of elongated workpieces having one or more areas of enlarged cross-section disposed therealong.

Sucker rods are utilized in the petroleum industry as a connecting link between a down hole oil well pump and the lifting or pumping device on the surface. Each rod is quite long, normally being on the order of magnitude of 25–30 feet. A major portion of the rod has a uniform cross-section with an enlargement being included adjacent each end thereof. These enlargements variously facilitate interconnecting a plurality of the rods in an end to end relationship with each other. While there are a number of specific or detailed modifications which may be included in the sucker rod configurations of different manufacturers, almost all such rods have the foregoing general conformation and characteristics.

As one of the manufacturing steps, the sucker rods are heated some predetermined temperature and then passed through an electrostatic spray chamber for having a coating of paint or plastic-like material applied thereto. Since the rods need only be surface heated for this purpose, induction type heating finds particular use in this environment. However, because sucker rods do not have uniform cross-sections throughout the entirety of their lengths, it is necessary to in some way compensate for the heating variations which otherwise occur at the enlargements adjacent the rod ends. Unless each rod is heated to a uniform temperature over the entire length thereof, the paint of plastic-like coating subsequently applied will not have a uniform consistency, thickness, etc. thereon, particularly as between the elongated rod portion and the enlargements.

A number of different arrangements to compensate for this difficulty have previously been proposed, developed and attempted. Such solutions include voltage regulation for the inductor, delay on and off timers, various alternative inductor configurations and the like. However, none of these proposed modifications have satisfactorily solved the problem of uniformly heating sucker rods or other elongated workpieces which have at least one enlarged area located at some point therealong.

It has, therefore, been considered desirable to develop an arrangement which facilitates uniform induction heating of sucker rods and other workpieces of the type described. The subject invention is deemed to provide method and apparatus which successfully overcome the foregoing problems. Moreover, the invention is equally applicable to use in tempering, case hardening, through hardening and normalizing of sucker rods or other workpieces.

BRIEF SUMMARY OF THE INVENTION

The present invention relates to inductively heating an elongated metal workpiece to a generally uniform temperature over the entire workpiece length and where at least one area of enlarged cross-section is included thereon. The invention utilizes variations in the energization levels of the inductor for different areas or sections of the workpiece and is particularly adapted for use in heating sucker rods of the type employed in the petroleum industry.

According to the present invention, the method comprises the steps of:

(a) providing a multi-turn inductor having an entrance end and an exit end with the inductor being generally coaxially disposed about an elongated workpath;

(b) feeding the workpiece longitudinally along the workpath at some preselected rate of travel toward and through the inductor from the entrance end;

(c) causing the inductor to be energized to a preselected first level for inductively heating one portion of the workpiece to a generally preselected temperature as it passes through the inductor during the step of feeding;

(d) changing the energization of the inductor to a preselected second level different from the first level at some preselected time during the step of feeding for inductively heating another workpiece portion to generally the preselected temperature as it passes through the inductor; and, (e) thereafter returning the inductor to the first level of energization.

According to another aspect of the invention, the method further includes the step of sensing the workpiece one portion adjacent the entrance end of the inductor with said step of changing occurring at some predetermined time interval following sensing.

According to yet another aspect of the invention, the workpiece includes an enlargement adjacent each end thereof wherein the first level of inductor energization is greater than the second level.

In accordance with a still further aspect of the invention, the step of providing includes a plurality of substantially identical inductors laterally spaced apart from each other coaxially about a plurality of parallel spaced apart workpaths and electrically interconnected with each other. The step of feeding comprising simultaneously passing identical workpieces along the plurality of workpaths.

In accordance with another aspect of the invention, apparatus is provided for inductively heating an elongated workpiece having two enlarged end portions separated by an elongated body portion of generally uniform cross-section. The apparatus allows the workpiece to be uniformly heated by means of a multi-turn induction heating coil having a power supply with the output power thereof being shiftable between first and second levels. Conveying means and sensing means facilitate selective shifting of the power supply so that the workpiece end portions will be heated with a first power level at a given feed rate and the workpiece body portion will be heated with a second power level at the given feed rate.

The principal object of the present invention is the provision of a new method and apparatus for inductively heating an elongated workpiece to a generally uniform temperature where at least one enlargement is included along the workpiece length.

Another object of the invention is the provision of such method and apparatus for use in uniformly heating a sucker rod prior to performing a manufacturing operation thereon.

Still another object of the invention is the provision of a new method and apparatus for uniformly heating an elongated workpiece which includes at least one area having an enlarged cross-section and wherein the workpiece heating levels and feed parameters may be adjusted to accommodate a variety of end results.

Further objects and advantages for the invention will become readily apparent to those skilled in the art upon a reading and understanding of the following specification.

BRIEF DESCRIPTION OF THE DRAWINGS

The invention may take physical form in certain parts and arrangements of parts, preferred and alternative embodiments of which will be described in detail in the following specification and illustrated in the accompanying drawings which form a part hereof and wherein:

FIG. 1 is a schematic side elevational view of apparatus employed in practicing the new heating method;

FIG. 2 is a partial view of the arrangement of FIG. 1 showing the lead end of a sucker rod entering the inductor;

FIG. 3 is a view similar to FIG. 2 showing the trailing end of the sucker rod as it leaves the proximity of a sensing means prior to entering the inductor;

FIG. 4 is a view similar to FIG. 2 with the trailing end of the sucker rod operatively disposed in the inductor;

DETAILED DESCRIPTION OF PREFERRED AND ALTERNATIVE EMBODIMENTS

Figure 5:
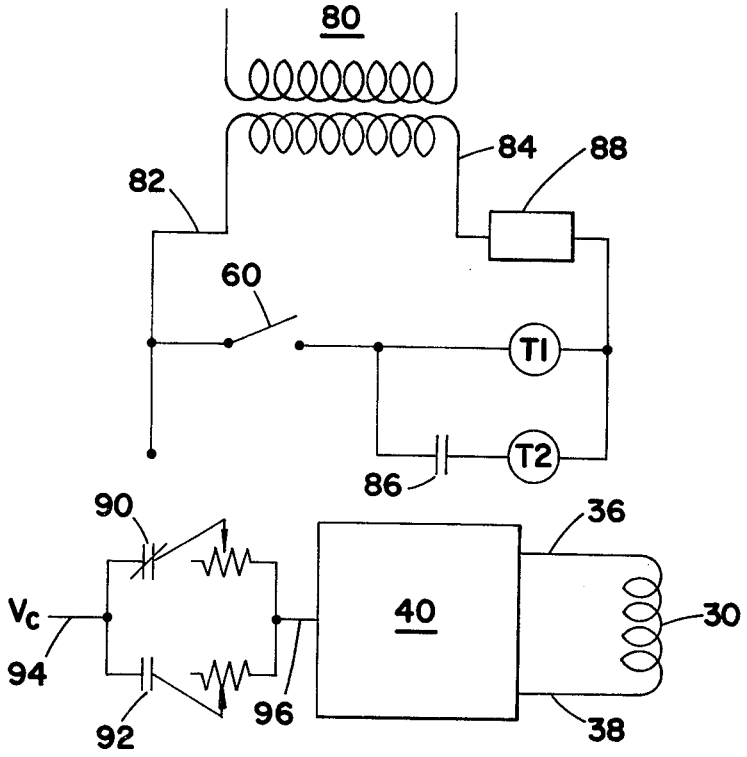
FIG. 5 is a wiring schematic showing the manner of apparatus operation in practicing the subject new method.

Referring now to the drawings wherein the showings are for purposes of illustrating preferred and alternative embodiments of the invention only and not for purposes of limiting same, FIG. 1 shows an elongated sucker rod A operatively disposed on an induction heating apparatus B prior to being heated. It is desired to uniformly heat the sucker rod over the entire length thereof prior to passage into an electrostatic spraying chamber C for purposes of receiving a coat of paint or plastic-like material. It should be appreciated, however, that the particular new heating method involved may be readily adapted to use in tempering, hardening and normalizing operations for sucker rods.

Figure 6:
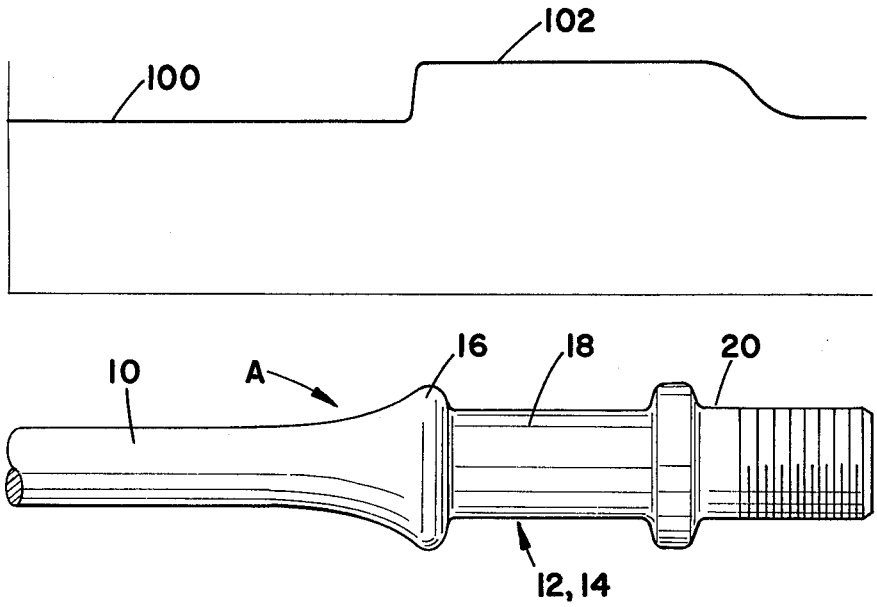
FIG. 6 is a graph demonstrating the power levels employed in heating those portions or sections of the sucker rod which are also shown.

More particularly, and with reference to both FIGS. 1 and 6, sucker rod A is constructed from steel or other ferrous material and which includes an elongated main or central portion 10 having enlargements 12,14 of the opposed ends thereof. Central portion 10 may be circular, hexagonal or the like in cross-section and is generally uniform over the entire length. Enlargements 12,14 are similar to each other and, as best shown in FIG. 6, include a bead portion 16, a wrench square or flats portions 18 and a box or pin portion 20. In the particular sucker rod illustrated, portions 20 comprise threaded male pins. In this manner, double ended female couplings may be employed to mechanically interconnect a plurality of the sucker rods to a desired overall length for use in an oil well.

Typically, the cross-sectional dimension of central portion 10 will range between 0.5"–1.125" with the maximum cross-sectional dimension of enlargements 12,14 generally ranging between 1.0"–2.25". The overall length of the rod is approximately 25'–30' with the length of each enlargement 12,14 being relatively small, i.e., typically on the order of magnitude of a few to several inches. It should be appreciated that other forms of sucker rods are also available. For example, some rods have a threaded male pin at one end and a female pin receiving box at the other to allow direct interconnection therebetween. The subject new heating method is, however, deemed equally applicable with this as well as other alternative forms of the rods.

During sucker rod manufacture and processing, it is desired to heat each rod to some uniform temperature for purposes of accommodating the application of a paint or plastic type coating thereto. To that end, the steps of the new method when heating sucker rod A are shown in FIGS. 1–4. It will be appreciated that these same heating steps may be advantageously utilized in other processing steps for the sucker rods as deemed necessary and/or appropriate to meet predetermined manufacturing standards. Such other processing steps include, for example, tempering, hardening, normalizing and the like. In FIG. 1, an induction heating apparatus B is shown and includes a multi-turn inductor generally designated 30. The inductor is comprised of a cylindrical copper coil having a plurality of spaced apart, generally circular loops as is known in the art. The individual coils or loops are hollow to define a continuous fluid passageway therethrough for accommodating a suitable coolant from a source (not shown) disposed adjacent to the overall induction heating apparatus as is also known in the art. The inductor has an entrance end 32 and an exit end 34 with leads 36,38 connecting it to a power source 40. Preferably, the distance between ends 32,34 is approximately the same as the length of enlargements 12,14. Also, power source 40 comprises an inverter or oscillator, although other types or styles of power sources having appropriate output capabilities could also be employed.

Inductor 30 is shown as being disposed in an open ended housing 50 with this housing and the coil being operatively mounted to the upper surface portion 52 of a stationary frame or base 54. The relative dimensioning between the base and coil are such that inductor 30 is coaxially disposed about an elongated workpath W. A sensing means 60 which may comprise a limit switch, proximity switch, micro switch or the like is disposed in close operative proximity to workpath W in a spaced relationship from coil entrance end 32. Preferably, the spacing of sensing means 60 from the coil entrance end is at least sufficient so that the sensing means will not be adversely affected by operation of the coil. The sensing means senses the presence of sucker rod A as the rod travels longitudinally along workpath W and controls operation of inductor 30 in a manner to be described.

A workpiece support is provided for moving sucker rod A along workpath W at some predetermined rate of travel. This support may comprise any number of different types and is schematically designated in FIG. 1 by a plurality of support rollers 70. These rollers are sufficient in number and spaced apart from each other by appropriate distances to maintain adequate support for the sucker rod substantially over the entire length thereof. In addition, the sucker rod may be moved along workpath W by any number of feed means, including positive gripping means, drive rollers, conveyors and the like. Such arrangements are known in the art and do not, in and of themselves, comprise a part of the present invention. The feed means should, however, accommodate moving the rod at various predetermined rates of travel.

FIG. 5 shows a preferred circuit for controlling inductor 30 in accordance with the new method. In this arrangement, electrical voltage from a source 80 is stepped down as the transformer shown with leads 82,84 thereafter carrying the power to the remainder of the circuit. In the circuit, sensing means 60 is shown as being normally open with an on-delay timer T1 and an off-delay timer T2 being disposed in parallel with each other. The normally open contact 86 of timer T1 is disposed in the parallel branch with timer T2 and a fuse 88 is advantageously included in lead 84.

Timer T2 includes a normally closed contact 90 in parallel with a normally open contact 92. Contact 90 is connected in series with an adjustable high power level output control for inverter 40 and contact 92 is similarly connected in series with a low power level output control. A voltage controlled oscillator or inductron (not shown) provides an output Vc at lead 94. Depending on the position of contacts 90,92, either a high or low level output will be supplied to inverter 40 through lead 96 which, in turn, will cause inductor 30 to be energized to either a high or low level through leads 36,38. In the normal or steady state condition with no workpiece being processed, inductor 30 is maintained at some preselected high level of energization. This level is calculated to provide the desired heating for sucker rod enlargements 12,14 as a function of the rate of sucker rod travel along workpath W and through the inductor. In like manner, the low level of energization is calculated to provide the desired heating for sucker rod main or central portion 10 as a function of the rate or sucker rod travel.

When rod A approaches the inductor as shown in FIG. 1, sensing means 60 senses the presence of the rod lead end, i.e., enlargement area 12, and closes. Upon closure, on-delay timer T1 is immediately energized and begins to time out for closing normally open contact 86 after a predetermined time interval. As timer T1 is timing out, contact 90 remains closed so that inductor 30 is retained at the high level of energization. When contact 86 is closed, timer T2 is energized. The T2 timer is adjusted so that contact 90 remains open and contact 92 remains closed for retaining the inductor in its lower level of energization.

FIG. 2 shows sucker rod A as having been advanced along the workpiece so that enlargement 12 is inductively coupled with inductor 30. Enlarged area 12 will thus be heated to the predetermined temperature at the high level setting of inverter 40. Timer T1 is adjusted so that contact 90 will open and contact 92 will close as main or central portion 10 of the sucker rod adjacent enlargement 12 has completely entered the inductor. Simultaneously, inverter 40 is shifted from the high level to the low level of energization for heating the entire length of the main or central portion to the predetermined desired temperature. Sensing means 60 is retained in its closed condition during this period.

In FIG. 3, and as the trailing end of sucker rod A, i.e., enlargement 14, passes sensing means 60, the sensing means is moved back to its opened condition. Simultaneously, on-delay timer T1 opens contact 86 and the timer on off-delay timer T2 begins to run off. This delay provides time for allowing enlargement 14 to be moved from the position shown in FIG. 3 to the position of FIG. 4 where it is inductively coupled with inductor 30. That is, the timer T2 is set to allow sufficient time for enlarged area 14 to traverse the distance from sensing means 60 into the inductor. At that time, i.e., when the preselected time on timer T2 runs off, contact 90 is again closed and contact 92 is opened. This results in inverter 40 being simultaneously switched back to its high level condition in order that enlargement 14 will be heated to the desired temperature. Also, heating apparatus B is ready to receive the next sucker rod A which is to be heated.

Referring again to FIG. 1, and following heating in the manner described, sucker rod A passes into coating apparatus C for receiving a paint or plastic-like coating. Typically, this apparatus comprises an electrostatic spraying chamber spaced several feet along the workpath from the exit end of heating apparatus B. Apparatus C does not, in and of itself, comprise a part of the present invention and is not, therefore, described in detail. In addition, other types of apparatus may be substituted for the coating apparatus or all auxiliary apparatus may be eliminated when the broad concept of the invention is employed for other processing steps or is adapted to use with other types of workpieces in other environments.

FIG. 6 shows a typical relationship between the low level power 100 and high power level 102 in heating the portion of sucker rod A disposed vertically therebelow. It will be appreciated that high power level 102 is employed during the heating period for both enlargements 12,14 and that lower power level 100 is employed for heating the entirety of main or central portion 10. Lower and upper levels 100,102 will vary from the precise relationship shown in the graph as a function of the specific conformation of the sucker rod or other workpiece being heated and other processing parameters.

Figure 7:
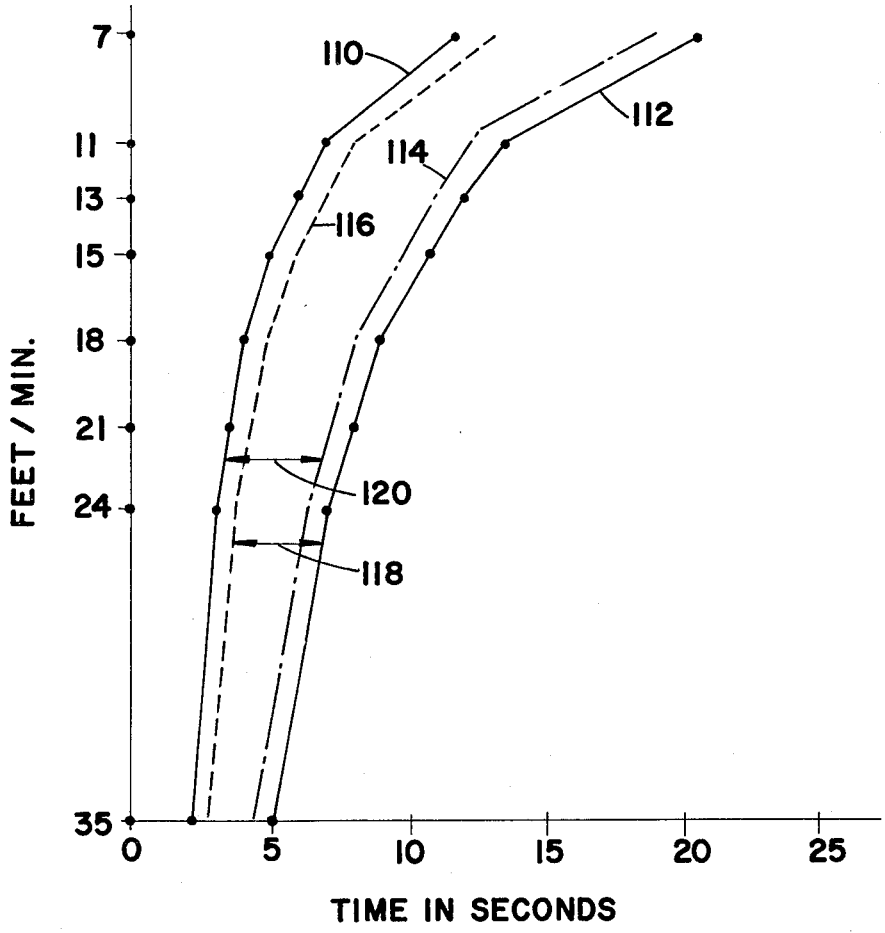
FIG. 7 is a graph of sucker rod feed rate versus time for showing implementation of the new method; and, FIG. 8 is a schematic plan view showing an alternative arrangement for inductively heating a plurality of sucker rods to a uniform temperature.

FIG. 7 is a graph of the workpiece feed rate in feet per minute versus various time intervals employed when using the method described above for obtaining uniform heating over the entire length of a sucker rod. The abscissa represents that instant during a heating cycle at which some point on the sucker rod passes sensing means 60. The graph relates only to heating of enlargements 12,14, it being understood that the inductor is energized at the lower power level during heating of main or central portion 10.

In FIG. 7, line 110 represents the time from trigger, i.e., passing sensing means 60, to reaching inductor 30 and line 112 represents the time before exiting the inductor. Thus, the horizontal distance between lines 110,112 for any feed rate comprises the time that any point on the rod will be disposed within the inductor. Line 114 represents the time delay provided by on-delay timer T1 as described above prior to shifting the inverter from the upper power level to the lower power level following heating of enlargement 12 at the leading end of the rod. Line 116 represents the time delay provided by off-delay timer T2 in the manner described prior to shifting the inverter from the lower power level back to the upper power level for heating enlargement 14 at the trailing end of the rod. The relative difference between these two time delays from triggering is necessitated by the fact that enlargement 12 is just approaching sensing means 60 when it is closed whereas enlargement 14 is already passing the sensing means when it is reopened. Thus, and from the time of trigger, a longer period of time is required before enlargement 12 is coupled with the inductor. Distance 118 represents the heating time for enlargement 12 and distance 120 represents the heating time for enlargement 14. These times are substantially identical, and, of course, occur at the upper power level of the inverter. As will be noted from the overall graph, the various time intervals involved vary significantly as a function of the sucker rod feed rate.

In the environment of heating sucker rods prior to applying a paint, epoxy or plastic-like coating thereto, the entire sucker rod is desirably heated to a uniform temperature of 475° F.±25° F. Prior apparatus and means for heating sucker rods in this environment have not been able to provide uniform heating within these parameters. However, in using the subject new method, sucker rods have been uniformly heated to 475° F.±12.5° F. This result is well within the desired range and facilitates a better coating application.

By way of one specific example, sucker rods with main portion 10 having a cross-section of 0.75" are desired to be heated at a feed rate of 15 feet per minute. The inductor used had an inside diameter of 3.375", a length of 5" and included 6 turns or loops. The high level power was set at 190 kilowatts and the low level power was set at 134 kilowatts. The T1 timer on delay was set at 9.0 seconds and the T2 timer off delay time was set at 7.25 seconds. In processing the sucker rods, substantially uniform rod heating was obtained falling in the range of 475° F.±12.5° F. These results are superior to those obtained from the prior known heating methods or techniques used in this environment.

Figure 8:
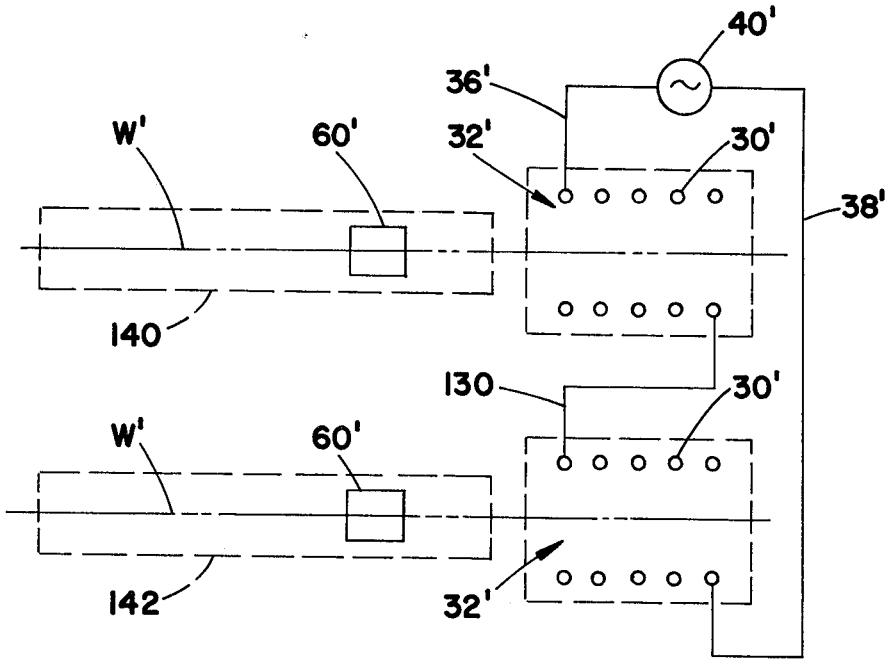

FIG. 8 is a schematic plan view of a slight modification utilized in practicing the subject invention. For ease of illustration and appreciation of this modification, like components are identified by like numerals with a primed (') suffix and new components are identified by new numerals.

In this FIGURE, a pair of multi-turn inductors 30' are disposed in a transversely spaced apart relationship coaxially about a pair of parallel spaced apart workpaths W'. As shown, inductors 30' are connected in series with each other to inverter 40' via leads 36',38' and 130. A sensing means 60' is associated with each of workpaths W' adjacent inductor entrance ends 32'. In this alternative, a pair of sucker rods are simultaneously moved along workpaths W' by rod support and feed mechanisms 140,142 for simultaneous heating by inductors 30' in the same manner already described. Since shifting of the inductors between the upper and lower power levels will occur at the same time, it is necessary to process both rods along mechanisms 140,142 and through the associated of the inductors in a simultaneous fashion. Otherwise, one of the rods will be improperly and non-uniformly heated.

FIG. 8, of course, only shows use of a pair of multi-turn inductors 30'; however, it should be appreciated that a greater number of such coils could be employed if and as desired. Moreover, the plural coils may also be connected in either series or parallel relationships with each other. In addition, many other alternative arrangements and constructions are possible in practicing the subject inventive concept for accommodating different types of workpieces and workpiece processing parameters.

The invention has been described with reference to the preferred and an alternative embodiment. Obviously, modifications and alterations will occur to others upon a reading and understanding of the specification. it is intended to include all such modifications and alterations insofar as they come within the scope of the appended claims or the equivalents thereof.

Having thus described the invention, it is now claimed:

1. A method for inductively heating an elongated workpiece to a generally uniform temperature over the length thereof wherein said workpiece has a first portion with a uniform cross-section extending over a major part of the workpiece length and a second portion with a cross-section greater than said one portion, said method comprising the steps of:

(a) providing a plurality of substantially identical multi-turn inductors, each having an entrance end and an exit end, with said inductors being laterally spaced apart from each other coaxially about a plurality of parallel spaced apart workpaths;

(b) feeding simultaneously substantially identical workpieces longitudinally along said plurality of workpaths at some predetermined rate of travel toward and through said inductors from said entrance end, each of said workpieces having a first portion with a uniform cross-section extending over a major portion of the workpiece length and a second portion with a cross-section greater than said first portion;

(c) sensing one of said workpiece first and second portions adjacent the entrance end of each inductor;

(d) causing each inductor to be energized to a preselected first level at least during said step of feeding for inductively heating said one of said workpieces first and second portions to generally a preselected temperature as it passes through the inductor;

(e) changing the energization level of each inductor to a predetermined second level different from said first level at some first preselected time interval following said step of sensing for inductively heating the other of said workpiece first and and second portions to generally said preselected temperature as it passes through the inductor; and, (f) thereafter returning each inductor to said first level of energization.

2. A method for effecting uniform induction heating of a sucker rod having a substantially uniform cross-section over a major portion of the rod length with a generally similar enlarged area disposed adjacent each of the opposite rod ends, said method comprising the steps of:

(a) providing a plurality of substantially identical multi-turn inductors, each inductor having an entrance end and an exit end, with said inductors being laterally spaced apart from each other generally coaxially about a plurality of parallel spaced apart workpaths;

(b) electrically interconnecting said inductors with each other;

(c) feeding simultaneously substantially identical sucker rods longitudinally along said workpaths at some preselected rate of travel toward and through said inductors from said entrance end, each of said sucker rods having a substantially uniform cross-section over a major portion of the rod length with a generally similar enlarged area disposed adjacent each of the opposite rod ends;

(d) sensing said rods as a first enlarged area associated with each rod leading end approaches said inductors entrance end during said step of feeding;

(e) having each inductor simultaneously energized to a first level for inductively heating said first enlarged area to generally a preselected temperature as it passes through the inductor during said step of feeding;

(f) changing simultaneously the level of energization of each inductor to a second level lower than said first level after some preselected first time interval following sensing for inductively heating the rod major portion to generally said preselected temperature as it passes through the inductor during said step of feeding;

(g) continuing said step of sensing until a second enlarged area associated with the rod trailing end approaches each inductor entrance end; and, (h) returning simultaneously each inductor to said first level of energization following said step of continuing in order to inductively heat said second enlarge area to generally said predetermined temperature as it passes through the inductor during said step of feeding.

* * * * *

UNITED STATES PATENT AND TRADEMARK OFFICE

CERTIFICATE OF CORRECTION

PATENT NO. : 4,433,226

DATED : February 21, 1984

INVENTOR(S) : Richard L. Wagar

It is certified that error appears in the above-identified patent and that said Letters Patent are hereby corrected as shown below:

On the title page, in Item [56] References Cited, cancel "294,932 8/1882" and insert -- 4,418,259 11/1983 --; cancel "390,409 6/1882" and insert -- 4,420,667 12/1983 --; cancel "358,446 3/1882" and insert -- Appln. Ser. No. 358,446 Filed 3/15/82--. Column 1, line 36, after "heated" insert -- to --; line 48, "of" should read -- or --. Column 3, line 66, cancel "of" and insert -- at --. Column 4, line 4, "portions" should read -- portion --. Column 5, line 20, after "as" insert -- at --. Col. 7, line 55, after "associated" insert --one --. Column 8, line 12, "it" should read -- It --; line 36, "portion" should read -- part --; line 44, "workpieces" should read -- workpiece --; line 51, delete "and" (second occurrence). Column 10, line 14, "enlarge" should read -- enlarged --.

Signed and Sealed this

Twenty-third Day of October 1984

[SEAL]

*Attest:*

GERALD J. MOSSINGHOFF

*Attesting Officer*

*Commissioner of Patents and Trademarks*